US007988151B2

(12) United States Patent
Kinoshita et al.

(10) Patent No.: US 7,988,151 B2
(45) Date of Patent: Aug. 2, 2011

(54) MEDIA DIVERSION MECHANISM FOR A SHEET MEDIA PROCESSING DEVICE, AND A MEDIA PROCESSING DEVICE

(75) Inventors: Yoshiki Kinoshita, Suwa (JP); Kenichi Hirabayashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 422 days.

(21) Appl. No.: 12/218,513

(22) Filed: Jul. 16, 2008

(65) Prior Publication Data

US 2009/0184465 A1 Jul. 23, 2009

(30) Foreign Application Priority Data

Jul. 18, 2007 (JP) ..... 2007-186607

(51) Int. Cl.
*B65H 39/10* (2006.01)

(52) U.S. Cl. ..... 271/303

(58) Field of Classification Search ..... 271/303–305, 271/149, 150

See application file for complete search history.

(56) References Cited

U.S. PATENT DOCUMENTS

| | | | | |
|---|---|---|---|---|
| 3,162,437 | A * | 12/1964 | Matthew et al. | 271/183 |
| 4,047,712 | A | 9/1977 | Burkhardt et al. | |
| 4,913,295 | A | 4/1990 | Murphy et al. | |
| 7,258,500 | B2 | 8/2007 | Furihata et al. | |
| 2004/0144697 | A1 | 7/2004 | Ramonowski | |
| 2007/0291328 | A1 | 12/2007 | Furihata et al. | |

FOREIGN PATENT DOCUMENTS

| | | |
|---|---|---|
| EP | 0516539 A1 | 12/1992 |
| JP | 07-033307 | 2/1995 |
| JP | 2004-206362 | 7/2004 |
| JP | 2006-155458 | 6/2006 |

OTHER PUBLICATIONS

European Search Report for 08012907.5, dated Jul. 7, 2009. (6 pages).

* cited by examiner

*Primary Examiner* — Stefanos Karmis
*Assistant Examiner* — Thomas A Morrison
(74) *Attorney, Agent, or Firm* — Nutter McClennen & Fish LLP; John J. Penny, Jr.; Rory P. Pheiffer

(57) ABSTRACT

A check processing device conveys checks into branch paths without the check jamming. The downstream end of the check transportation path 7 of the check processing device 1 is split by a diversion unit 18 into first and second branch paths 11 and 12. The diversion unit 18 has diversion unit guide surfaces 18*a* and 18*b* that diverge to the right and left, and a diversion unit top 18*c* that connects the top edges of the diversion unit guide surfaces 18*a* and 18*b*. A branch switching lever or flapper 19 is located at the branching position A. The diversion unit top 18*c* slopes upward from the lever top 19*c* in the diversion direction on both right and left sides, and also slopes upward from the top edges of the diversion unit guide surfaces 18*a* and 18*b* perpendicularly to the diversion direction. If a check 6 with a drooping top is advanced to the branching position A, the drooping portion is guided by the diversion unit top 18*c* up and over the diversion unit 18, thereby enabling the check 6 to enter the first or second branch path 11 or 12 without colliding with the diversion unit 18.

14 Claims, 5 Drawing Sheets

MEDIA DIVERSION MECHANISM FOR A SHEET MEDIA PROCESSING DEVICE, AND A MEDIA PROCESSING DEVICE

Priority is claimed under 35 U.S.C. §119 to Japanese Patent Application 2007-186607 filed on Jul. 18, 2007, which is hereby incorporated by reference in its entirety.

BACKGROUND OF THE INVENTION

1. Field of Invention

The present invention relates to a sheet media processing device that has a mechanism for distributing sheet media conveyed from a transportation path into one of a plurality of diversion paths. The invention relates more particularly to a diversion mechanism for the sheet media processing device that routes the sheet media to the desired path without the media jamming. The invention also relates to a media processing device that has this diversion mechanism.

2. Description of Related Art

Stores as well as banks and other financial institutions commonly use check processing devices (also referred to as a "check reader" or "check scanner") to image and read magnetic ink characters from financial instruments such as checks presented by customers. The captured image data and magnetic ink character information is also computer processed for transaction processing. However, the magnetic ink characters required for transaction processing cannot be read from some presented checks. The check processing device therefore stores the checks from which the magnetic ink characters cannot be read in a separate media storage unit.

The check processing device processes checks while conveying the checks standing on edge through a transportation path rendered as a narrow vertical slot-like channel. The downstream end of the transportation path branches into left and right channels into which the checks are directed at the junction with the main transportation path, and a media storage unit is disposed at the downstream end of both branch paths. A path-switching lever, or flapper, that directs the checks conveyed thereto into one of the branch paths is disposed at the junction where the paths diverge. See, for example, Japanese Unexamined Patent Appl. Pub. JP-A-2004-206362.

The width of the most commonly used check sizes ranges from 60 to 125 mm. When a wide (tall) check is loaded into the check processing device, the top part of the check typically protrudes above the top of the transportation path, and the protruding part of the check may be rather large. This can result in the exposed top part of the check drooping to one side as the check is conveyed through the transportation path. In addition, if a check that has been crumpled or wrinkled or that has lost its stiffness is loaded into the check processing device, the top part of the check exposed from the top of the transportation path may also droop to the side even if the check is not particularly wide. When a check that thus droops to the side for any reason is fed to the diversion point of the transportation path, the portion of the check that hangs to the side collides with the diversion mechanism and causes the check to jam.

A problem with the related art is thus that when an edge portion of the check is drooping or bent over and this bent portion of the check collides with the diversion unit of the transportation path, the check may become jammed.

SUMMARY OF THE INVENTION

The diversion mechanism of a sheet media processing device according to the present invention enables a check to enter a branch path without colliding with the diversion unit. Another aspect of the invention is a media processing device that has the diversion mechanism of the invention.

A diversion mechanism for a sheet media processing device, the diversion mechanism having a diversion unit that splits a sheet media transportation path into right(first) and left(second) branch paths, and a branch switching lever that directs sheet media conveyed to the branch path diversion position into one of the branch paths. The diversion unit has left and right diversion unit guide surfaces that spread apart in the left and right diversion directions, and a diversion unit top that connects the top edges of the diversion unit guide surfaces. The branch switching lever has left and right lever-side guide surfaces that spread apart in the left and right diversion directions, and a lever top that connects the top edges of the lever-side guide surfaces. The diversion unit top slopes upward in the left and right diversion directions from the lever top, and slopes upward perpendicularly to the diversion directions from the top edges of the left and right diversion unit guide surfaces.

In this aspect of the invention the diversion unit has a top that slopes in three dimensions above the branch switching lever. As a result, if the top part of the sheet medium is drooping to one side when the sheet medium enters one of the branch paths, this drooping top part of the sheet medium is guided by this diversion unit top to ride over the diversion unit. The sheet medium therefore avoids colliding with the end of the diversion unit as the sheet medium enters the branch path, and the sheet medium can therefore enter the branch path without jamming.

In order to guide the drooping part of the sheet medium upward perpendicularly to the diversion direction, the shape of the diversion unit top perpendicularly to the diversion direction is preferably a convex curve when seen in section view.

Further preferably, the diversion unit top has a mirror-surface finish in order to guide the drooping part of the sheet medium smoothly. Further preferably, the left and right guide surfaces of the diversion unit diverge at an angle less than 90 degrees.

Yet further preferably, the left and right diversion unit guide surfaces are positioned set back to the inside from imaginary lines extending the left and right lever-side guide surfaces in the diversion directions so that the sheet medium guided into a branch path by a lever-side guide surface does not collide with the diverting guide surface of the diversion unit.

A diversion mechanism according to another aspect of the invention for a sheet media processing device has a diversion unit that splits a sheet media transportation path into at least two branch paths, and a branch switching lever that directs sheet media conveyed to the branch path diversion position into one of the branch paths. The diversion unit has diversion unit guide surfaces that spread apart in the diversion direction, and a diversion unit top that connects the top edges of the diversion unit guide surfaces. The branch switching lever has lever-side guide surfaces that spread apart substantially in the diversion direction, and a lever top that connects the top edges of the lever-side guide surfaces. The lever top slopes upward in the diversion direction, and slopes upward perpendicularly to the diversion direction from the top edges of the lever-side guide surfaces. The diversion unit guide surfaces are positioned set back to the inside from imaginary lines extending the lever-side guide surfaces in the diversion directions, and the edge portion of the diversion unit top on the branch switching lever side is positioned below an imaginary line extending the lever top in the diversion direction.

In this aspect of the invention the branch switching lever has a top that slopes in three dimensions. The edges of the left and right diversion unit guide surfaces and the diversion unit top are also set back from the plane of the lever-side guide surfaces and the lever top. As a result, if the top part of the sheet medium is drooping to one side when the sheet medium enters one of the branch paths, this drooping top part of the sheet medium is guided by this lever top to ride up and over the diversion unit. The sheet medium can therefore enter the selected diversion path without jamming because the diverted sheet medium entering the branch path is prevented from colliding with the end of the diversion unit.

Another aspect of the invention is a media processing device having a diversion mechanism that has a diversion unit that splits a media transportation path into at least two branch paths, and a branch switching lever that directs media conveyed to the branch path diversion position into one of the branch paths. The diversion unit has diversion unit guide surfaces that spread apart in the diversion direction, and a diversion unit top that connects the top edges of the diversion unit guide surfaces. The branch switching lever has lever-side guide surfaces that spread apart in the diversion direction, and a lever top that connects the top edges of the lever-side guide surfaces. The diversion unit top slopes upward in the diversion direction from the media transportation direction side, and slopes upward perpendicularly to the diversion direction from the top edges of the diversion unit guide surfaces.

Effect of the Invention

If the top part of a sheet medium is drooping to the side when the sheet medium is guided into one of the branch paths, the diversion mechanism for a sheet media processing device according to the present invention guides the drooping part of the medium up and along the top of the diversion unit so that the drooping portion of the medium rides over the diversion unit. As a result, the sheet medium can be prevented from colliding with the end of the diversion unit when the sheet medium enters one of the branch paths, and can therefore travel unimpeded into the branch path without becoming jammed.

In the diversion mechanism according to another aspect of the invention, the branch switching lever has a top that slopes in three dimensions. The edges of the left and right diversion unit guide surfaces and the diversion unit top are also set back from the plane of the lever-side guide surfaces and the lever top. As a result, if the top part of the sheet medium is drooping to one side when the sheet medium enters one of the branch paths, this drooping top part of the sheet medium is guided by this lever top to ride up and over the diversion unit. The sheet medium can therefore enter the selected diversion path without jamming because the diverted sheet medium entering the branch path is prevented from colliding with the end of the diversion unit.

Other objects and attainments together with a fuller understanding of the invention will become apparent and appreciated by referring to the following description and claims taken in conjunction with the accompanying drawings.

DESCRIPTION OF PREFERRED EMBODIMENTS

A preferred embodiment of a check processing device having a diversion mechanism according to the present invention is described below with reference to the accompanying figures.

General Configuration

Figure 1A:
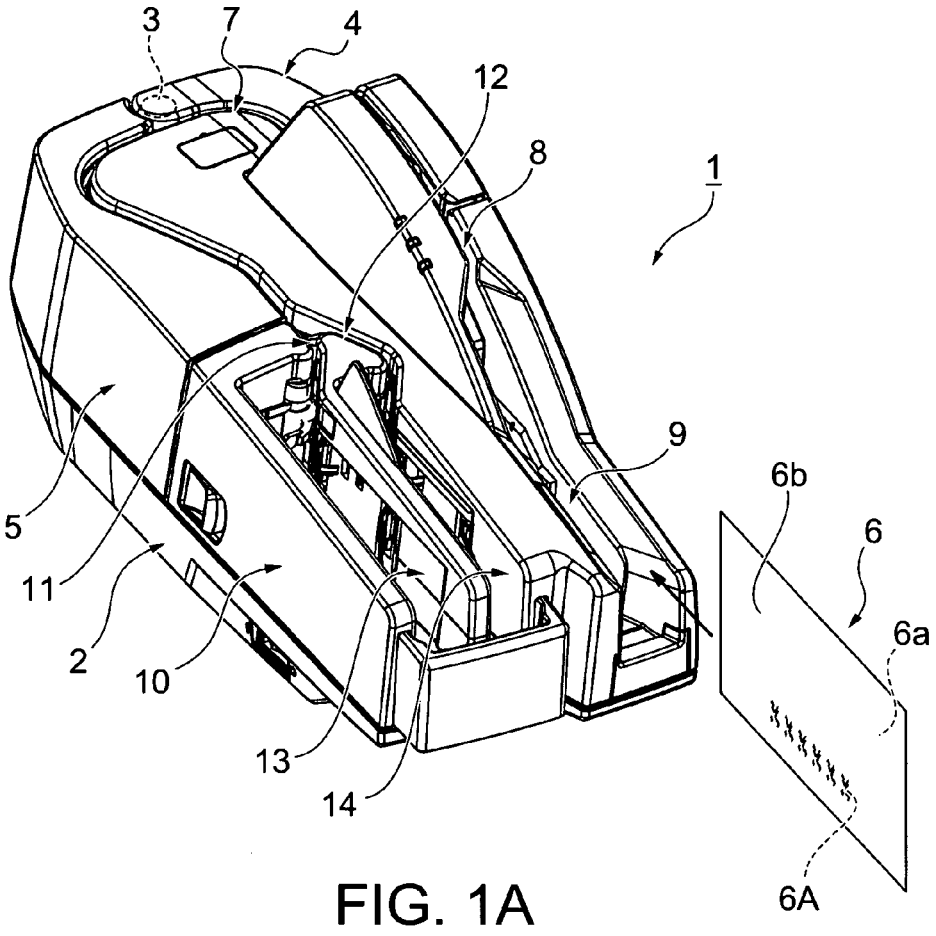
FIGS. 1A and 1B are oblique external views of a check processing device according to the present invention.
Figure 1B:
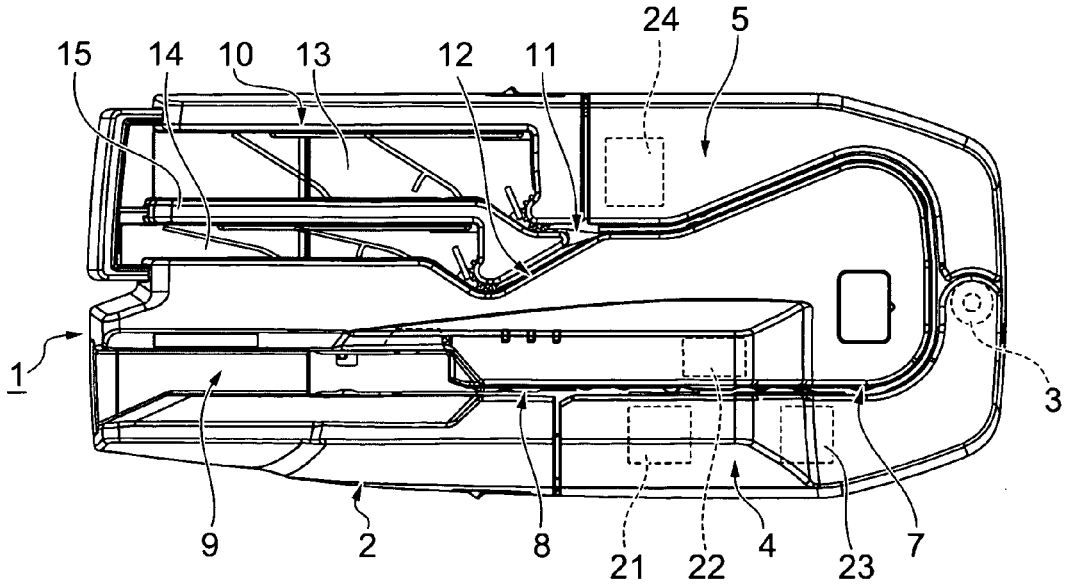

FIG. 1A is an external oblique view and FIG. 1B is a plan view of a check processing device 1 according to a preferred embodiment of the invention.

The check processing device 1 has a case 2 on the main unit and a pair of left and right access covers 4 and 5 that open and close pivoting on a vertical support pin 3 disposed at the back end of the case 2. A check transportation path 7 for conveying checks 6 is formed between the case 2 and the access covers 4 and 5.

The check transportation path 7 is a narrow vertical slot that curves in a basically U-shaped configuration when seen from above. The upstream end of the check transportation path 7 in the check transportation direction is connected through a check infeed path 8 that is a narrow vertical channel to a check supply unit 9, which is a wide vertical channel. The downstream end of the check transportation path 7 is connected to a check storage unit 10.

The check storage unit 10 has first and second branch paths 11 and 12 connected to the downstream end of the check transportation path 7, and first and second storage pockets 13 and 14 connected to the downstream ends of the first and second branch paths 11 and 12.

As shown in FIG. 1, each check 6 has an MICR line 6A printed along the long bottom edge on the front 6*a* of the check 6. Also recorded on the front 6*a* against a patterned background are the check amount, payer and payee, various numbers, and the payer signature. An endorsement is recorded on the back 6*b* of the check 6.

As indicated by the dotted lines in FIG. 1B, a front contact image scanner 21 for imaging the fronts of the checks 6, a back contact image scanner 22 for imaging the backs of the checks 6, a magnetic head 23 for reading magnetic ink characters, and a printing mechanism 24 for printing ELECTRONIC FUNDS TRANSFER, for example, on the check front are disposed in this order along the check transportation path 7.

After a check 6 is delivered from the check supply unit 9 through the check infeed path 8, the front and back sides of the check 6 are imaged and the magnetic ink character line 6A printed on the check front 6*a* is read as the check 6 travels through the check transportation path 7. If the information is read correctly, ELECTRONIC FUNDS TRANSFER or other information is printed on the check 6, and the check 6 is delivered to and stored in the first storage pocket 13. Checks 6 that cannot be scanned or read correctly are not printed and are diverted to and stored in the second storage pocket 14.

Branch Path Diversion Unit

Figure 2:
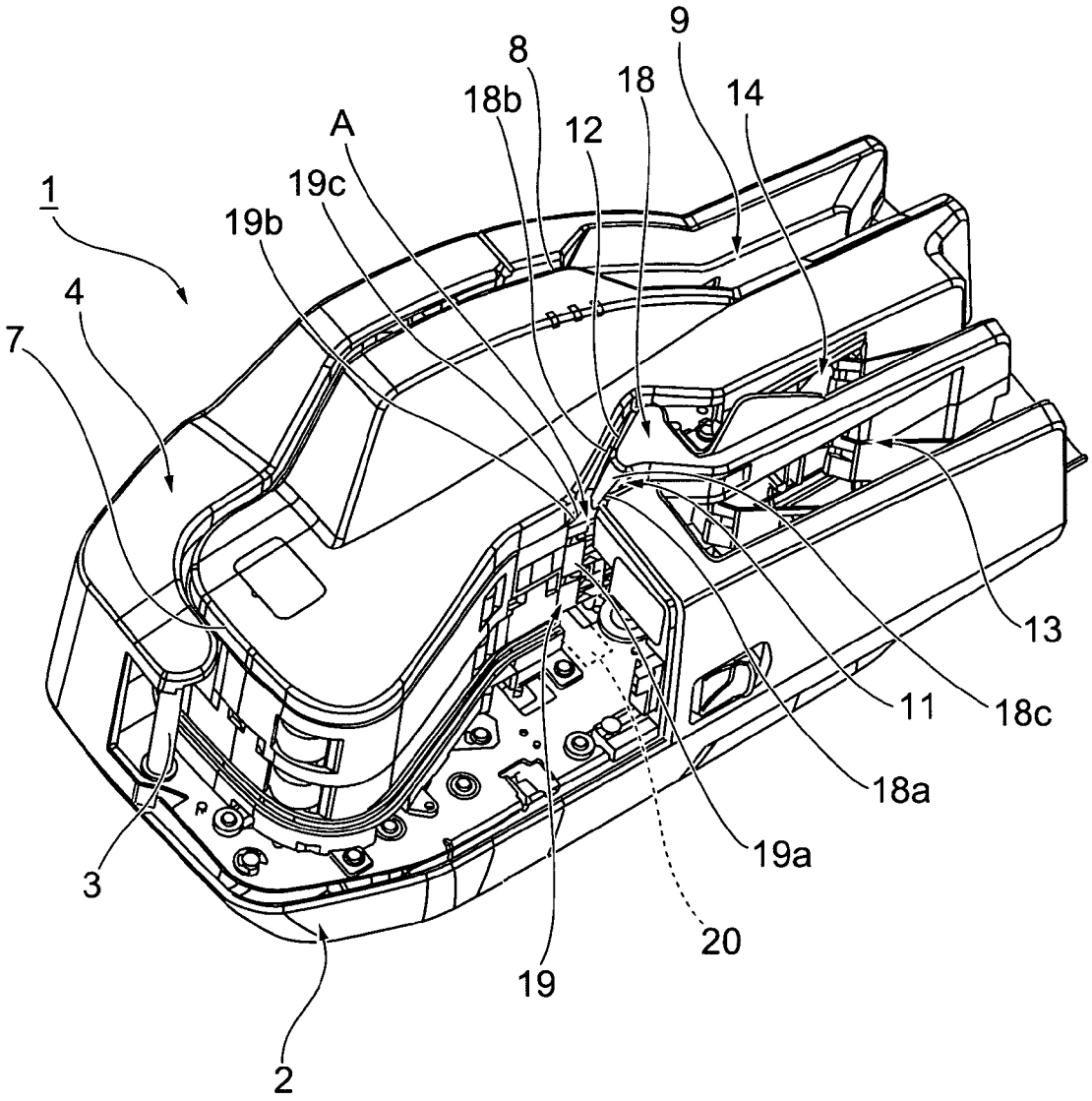
FIG. 2 is an oblique view of the check processing device with one of the access covers removed.

FIG. 2 is an oblique view of the check processing device with one of the access covers 5 removed.

The downstream end of the check transportation path 7 is divided into first and second branch paths 11 and 12 by a diversion unit 18. While the transportation path is divided into only two branch paths in this example, there could be three or more branches. The diversion unit 18 has right and left diversion unit guide surfaces 18*a* and 18*b*, and a diversion unit top 18*c* connecting the top edges of the diversion unit guide surfaces 18*a* and 18*b*. The diversion unit guide surfaces 18*a* and 18*b* spread apart to the right and left in the downstream branching direction from a vertex at the branching position A between the first and second branch paths 11 and 12.

The first branch path 11, of which one inside wall is defined by diversion unit guide surface 18*a*, continues in a straight line from the downstream end of the check transportation path 7.

The second branch path 12, of which one inside wall is defined by side guide surface 18*b*, branches at an angle of less than 90 degrees from the first branch path 11. The angle is approximately 30 degrees in this embodiment of the invention, but can be any angle less than 90 degrees and is not limited to 30 degrees.

A switching lever 19 (flapper) for directing the in-fed check 6 to either one of the first and second branch paths 11 and 12 is disposed at the branching position A. The flapper 19 has right and left flapper guide surfaces 19*a* and 19*b* that diverge to the right and left in the diversion directions of the first and second branch paths 11 and 12, and a level lever top 19*c* that covers the top edges of the flapper guide surfaces 19*a* and 19*b*.

When positioned as seen in FIG. 2, the flapper 19 closes the upstream end of the second branch path 12 so that a check 6 delivered to the branching position A from the upstream end at the check transportation path 7 is guided by the flapper guide surface 19*a* and enters the first branch path 11. The flapper 19 can also be switched by a switching mechanism 20 disposed below the branching position A to the position closing the upstream end of the first branch path 11. When the flapper 19 is thus switched, a check 6 travelling to the branching position A is guided by the flapper guide surface 19*b* and enters the second branch path 12.

Figure 3A:
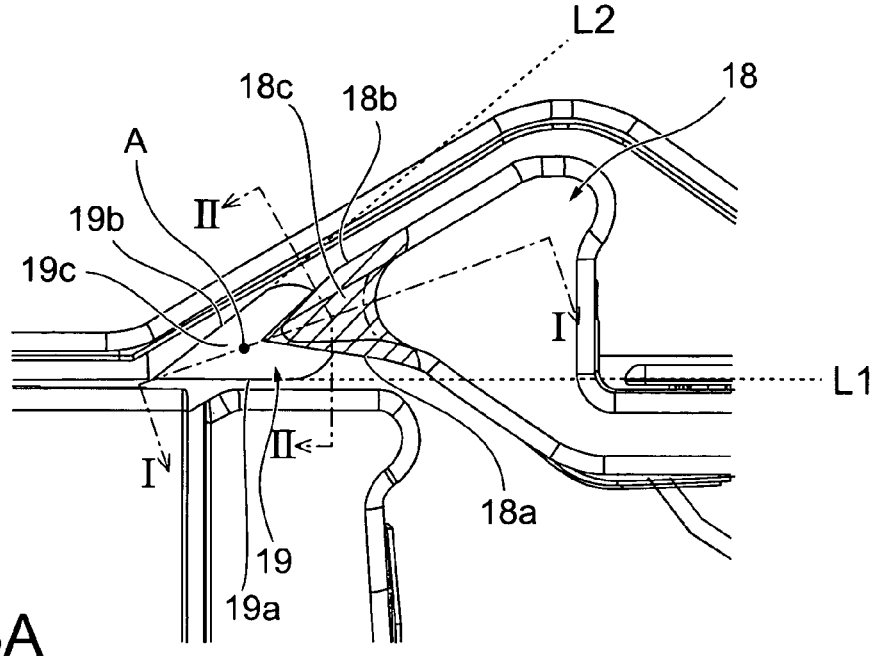
FIGS. 3A, 3B, and 3C are plan views and a section views showing the main parts at the diverter position.
Figure 3B:
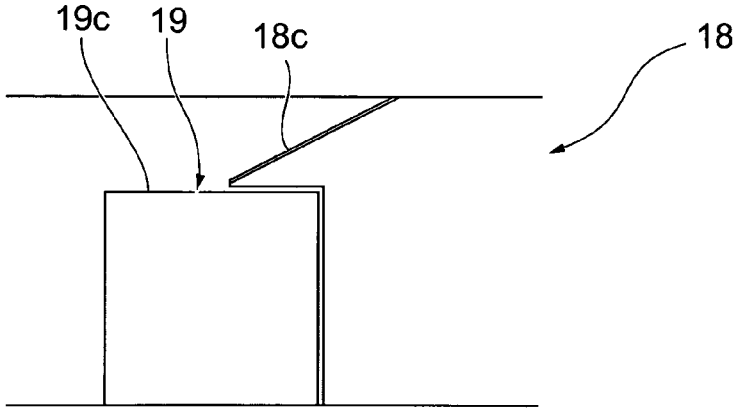
Figure 3C:
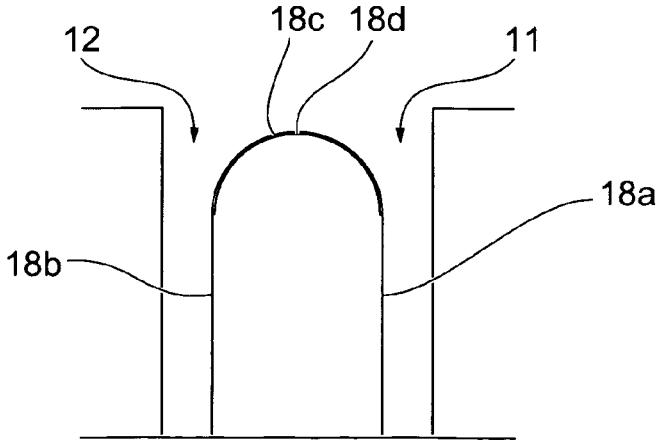

FIG. 3A is a plan view showing the main parts at the transportation path diversion position. FIG. 3B is a section view through line I-I in FIG. 3A, and FIG. 3C is a section view through line II-II in FIG. 3A. Line I-I passes through the branching position A and the center between the right and left diversion unit guide surfaces, and line II-II passes through diversion unit top perpendicularly to the direction of each branch path.

The diversion unit top 18*c* of the diversion unit 18 slopes upward from the lever top 19*c* in both left and right diversion directions, and also slopes upward from the top edges of the right and left diversion unit guide surfaces 18*a* and 18*b* perpendicularly to the diversion direction.

As shown in FIG. 3A, the diversion unit top 18*c* is substantially triangular when seen in plan view, and has an acute angle portion that is defined by the diversion unit guide surfaces 18*a* and 18*b* that spread apart to the right and left in the downstream branching direction from a vertex at the branching position A. The diversion unit top 18*c* is finished to a mirror surface. The right and left diversion unit guide surfaces 18*a* and 18*b* are located to the inside of imaginary lines L1 and L2 extending substantially in the diversion direction of the right and left flapper guide surfaces 19*a* and 19*b* of the flapper 19.

As shown in FIG. 3B, the diversion unit top 18*c* slopes upward in each of the diversion directions. As shown in FIG. 3C, the sectional shape of the diversion unit top 18*c* perpendicularly to the diversion directions is defined by a convex curved surface that bridges the top edges of the diversion unit guide surfaces 18*a* and 18*b* extending in the diversion directions.

Effect of the Diversion Mechanism

Figure 4A:
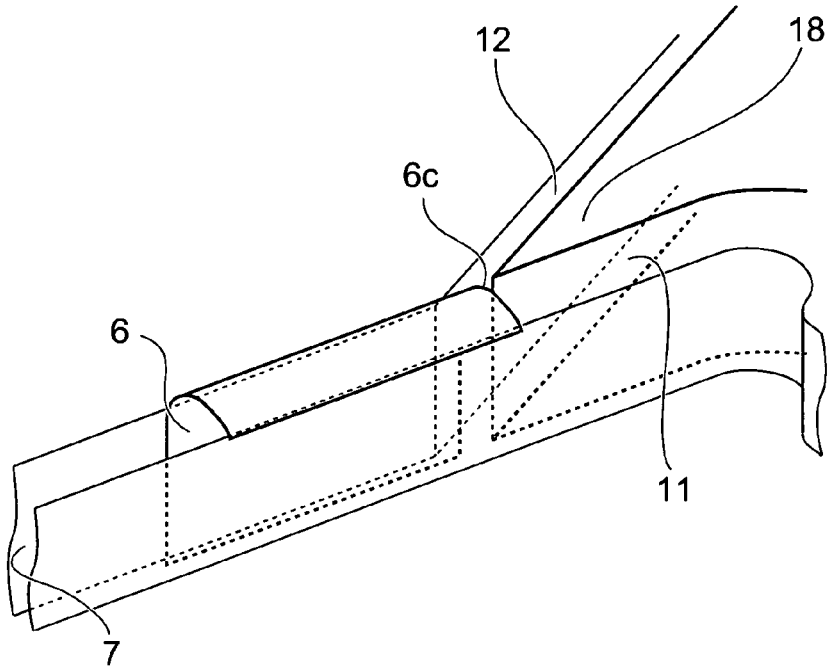
FIGS. 4A and 4B describe the operation guiding a check into the second branch path when the top of the check is drooping to the side.

The effect of the diversion mechanism rendered by the diversion unit having the foregoing diversion unit top is described below with reference to FIG. 4. FIG. 4A shows a diversion unit that does not have a diversion unit top as described above, and FIG. 4B shows a diversion unit with the foregoing diversion unit top.

When the top of the diversion unit 18 is flat as shown in FIG. 4A and a check 6 is directed into the second branch path 12, the drooping portion 6*c* at the top of the check 6 collides with the distal end of the diversion unit 18.

Figure 4B:
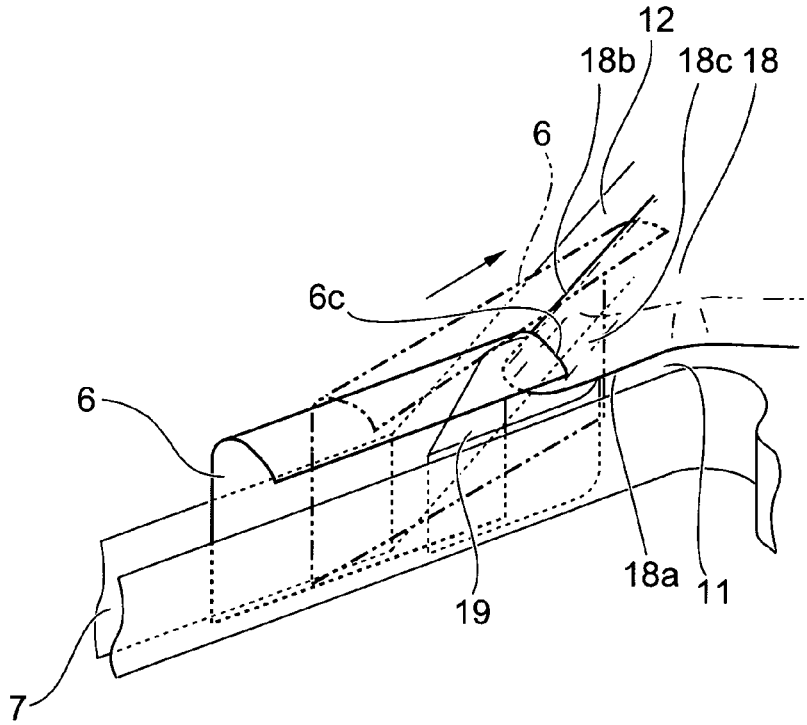

As shown in FIG. 4B, however, when the diversion unit 18 has a diversion unit top 18*c* as described above, the drooping portion 6*c* at the top of the check 6 is guided by the diversion unit top 18*c* to ride over the diversion unit 18, thereby avoiding a collision between the check 6 and the diversion unit 18.

More particularly, the diversion unit top 18*c* inclines upward in the directions in which the transportation path diverges (the check transportation direction) as well as perpendicularly to the diversion directions. The drooping portion 6*c* of the in-fed check is thereby gradually raised so that it passes over the diversion unit 18.

In addition, because the diversion unit top 18*c* has a mirror finish, the drooping portion 6*c* of the check 6 is guided smoothly up so that it rides over the diversion unit 18.

Furthermore, because the right and left diversion unit guide surfaces 18*a* and 18*b* are set back from the right and left flapper guide surfaces 19*a* and 19*b* of the flapper 19, the check 6 guided by the flapper guide surfaces 19*a* and 19*b* also does not collide with the diversion unit guide surfaces 18*a* and 18*b*.

If the top part of the check 6 droops over to the second branch path 12 side when the check 6 is guided into the first branch path 11, the drooping portion of the check is again guided up by the diversion unit top 18*c* so that it passes over the diversion unit 18. The check 6 is thus also prevented from colliding with the diversion unit 18 and jamming when the check 6 enters the first branch path 11.

Alternative Embodiments

In the embodiment described above the diversion unit top 18*c* has a convex curved surface when seen in a section view perpendicular to the branching directions of the first and second branch paths 11 and 12, but the diversion unit top 18*c* could be a flat inclined surface that slopes upward from the top edges of the guide surfaces 18*a* and 18*b* of the diversion unit 18.

In the embodiments described above the check transportation path 7 splits into two branch paths, but the structure of the diversion unit described above for directing checks to the desired branch path can be also be used when the check transportation path 7 splits into three or more branches.

The diversion unit top 18*c* is rendered to the diversion unit 18 as a three-dimensionally inclined surface for guiding the drooping portion 6*c* of a check 6 in the foregoing embodiments, but the lever top 19*c* of the flapper 19 can be rendered as a three-dimensionally inclined guide surface.

Figure 5A:
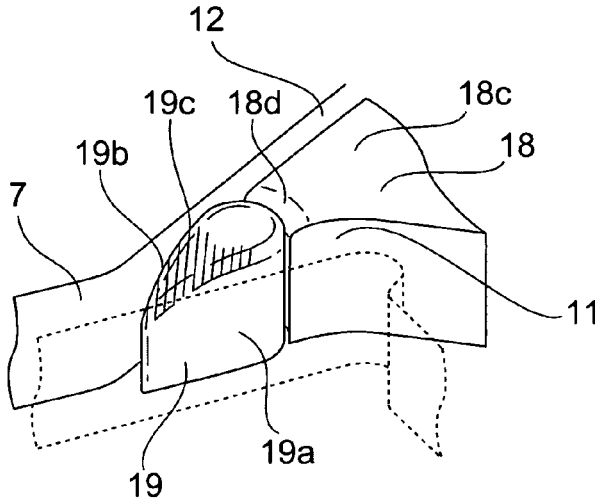
FIGS. 5A, 5B, and 5C are oblique views showing another example of the diversion mechanism according to the present invention.
Figure 5B:
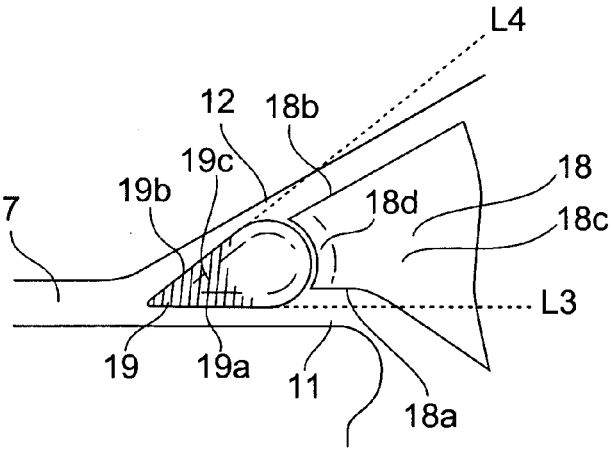
Figure 5C:
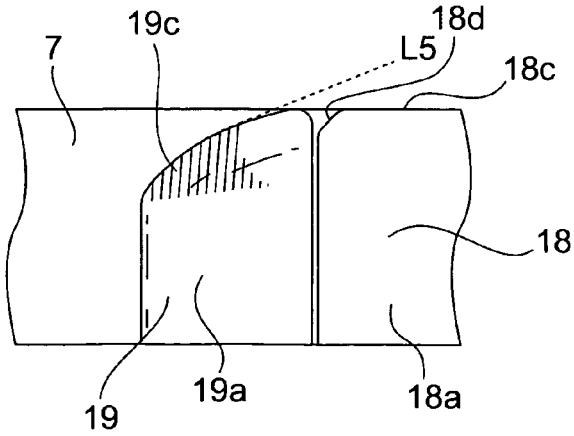

FIG. 5 shows an example in which the top of the path switching lever (flapper) is rendered as a three-dimensionally inclined guide surface. FIG. 5A is an oblique view of the diversion unit area, FIG. 5B is a plan view of the same, and FIG. 5C is a side view from the side of the flapper and the diversion unit.

In this configuration the lever top 19*c* slopes up in the right and left diversion directions while also sloping up from the top edges of the flapper guide surfaces 19*a* and 19*b* substantially perpendicularly to the directions in which the branch path diverges. More particularly, the lever top 19*c* is shaped similarly to the diversion unit top 18*c* described above.

If the top of the flapper is thus rendered as a three-dimensionally inclined guide surface and the right and left guide surfaces 18*a* and 18*b* of the diversion unit 18 are positioned set back to the inside from imaginary lines L3 and L4 extending substantially in the diversion direction of the right and left guide surfaces 19*a* and 19*b* of the flapper 19, a check 6 guided by the flapper guide surfaces 19*a* and 19*b* can be prevented from colliding with the diversion unit guide surfaces 18*a* and 18*b*. In addition, if the edge 18*d* of the diversion unit top 18*c* facing the flapper 19 is positioned below an imaginary line L5 extending the lever top 19*c* in the diversion direction, a check 6 guided by the lever top 19*c* can be prevented from colliding with the diversion unit top 18*c*.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A diversion mechanism for a sheet media processing device, comprising:

a diversion unit that splits a sheet media transportation path into first and second branch paths; and a branch switching lever that directs sheet media into one of the first and second branch paths;

wherein the diversion unit has first and second diversion unit guide surfaces that extend in first and second diversion directions, respectively, and a diversion unit top that connects top edges of the diversion unit guide surfaces:

the branch switching lever has first and second lever-side guide surfaces that extend substantially in the first and second diversion directions, and a lever top that connects top edges of the lever-side guide surfaces;

the diversion unit top slopes upward in the first and second diversion directions from the lever top, and slopes upward perpendicularly to the diversion directions from the top edges of the first and second diversion unit guide surfaces; and a top of the sheet media transportation path is below a top portion of the sheet media that is disposed in the sheet media transportation path.

2. The diversion mechanism for a sheet media processing device described in claim 1, wherein:

the shape of the diversion unit top perpendicularly to the diversion directions is a convex curve when seen in section view.

3. The diversion mechanism for a sheet media processing device described in claim 1, wherein:

the diversion unit top has a mirror-surface finish.

4. The diversion mechanism for a sheet media processing device described in claim 1, wherein:

the first and second diversion unit guide surfaces of the diversion unit diverge at an angle less than 90 degrees.

5. The diversion mechanism for a sheet media processing device described in claim 1, wherein:

the first and second diversion unit guide surfaces are positioned set back to the inside from imaginary lines extending from the first and second lever-side guide surfaces in the diversion directions.

6. The diversion mechanism for a sheet media processing device described in claim 1, wherein:

the first branch path extends substantially in the first diversion direction;

the second branch path extends substantially in the second diversion direction; and the diversion unit top slopes upward perpendicularly to the first and second diversion directions from the top edges of the first and second diversion unit guide surfaces.

7. A diversion mechanism for a sheet media processing device, comprising:

a diversion unit that splits a sheet media transportation path into at least two branch paths; and a branch switching lever that directs sheet media into one of the branch paths;

wherein the diversion unit has diversion unit guide surfaces that extend in first and second diversion directions, and a diversion unit top that connects top edges of the diversion unit guide surfaces;

the branch switching lever has lever-side guide surfaces that extend substantially in the first and second diversion directions, and a lever top that connects the top edges of the lever-side guide surfaces;

the diversion unit top slopes upward in the diversion directions, and slopes upward perpendicularly to the diversion direction from top edges of the lever-side guide surfaces;

the diversion unit guide surfaces are positioned set back to the inside from imaginary lines extending from the lever-side guide surfaces in the diversion directions;

the edge portion of the diversion unit top on the branch switching lever side is positioned below an imaginary line extending the lever top in the diversion directions; and a top of the sheet media transportation path is below a top portion of the sheet media that is disposed in the sheet media transportation path.

8. The diversion mechanism for a sheet media processing device described in claim 7, wherein:

a first branch path of the at least two branch paths extends substantially in the first diversion direction;

a second branch path of the at least two branch paths extends substantially in the second diversion direction; and the diversion unit top slopes upward perpendicularly to the first and second diversion directions from the top edges of the first and second diversion unit guide surfaces.

9. A media processing device comprising a diversion mechanism that has a diversion unit that splits a media transportation path into at least two branch paths and a branch switching lever that directs media into one of the branch paths;

wherein the diversion unit has diversion unit guide surfaces that extend in first and second diversion directions, and a diversion unit top that connects top edges of the diversion unit guide surfaces;

the branch switching lever has lever-side guide surfaces that extend in the diversion directions, and a lever top that connects top edges of the lever-side guide surfaces;

the diversion unit top slopes upward in the diversion directions from the media transportation direction side, and slopes upward perpendicularly to the diversion directions from the top edges of the diversion unit guide surfaces; and a top of the media transportation path is below a top portion of the media that is disposed in the media transportation path.

10. The media processing device described in claim 9, wherein:

the shape of the diversion unit top perpendicularly to the diversion directions is a convex curve when seen in section view.

11. The media processing device described in claim 9, wherein:

the diversion unit top has a mirror-surface finish.

12. The media processing device described in claim 9, wherein:

the diversion unit guide surfaces of the diversion unit diverge at an angle less than 90 degrees.

13. The media processing device described in claim 9, wherein:

the diversion unit guide surfaces are positioned set back to the inside from imaginary lines extending from the lever-side guide surfaces in the diversion directions.

14. The media processing device described in claim 9, wherein the at least two branch paths extend substantially in the first and second diversion directions, respectively; and the diversion unit top slopes upward perpendicularly to the first and second diversion directions from the top edges of the diversion unit guide surfaces.

* * * * *